United States Patent [19]

Cheeseman

[11] 4,017,174

[45] Apr. 12, 1977

[54] DEVELOPER ASSEMBLY SUPPORT

[75] Inventor: Robert Andrew Cheeseman, Hitchin, England

[73] Assignee: Xerox Corporation, Stamford, Conn.

[22] Filed: Oct. 14, 1975

[21] Appl. No.: 622,191

[30] Foreign Application Priority Data

Nov. 20, 1974 United Kingdom ..... 50316/74

[52] U.S. Cl. ..... 355/10; 118/262

[51] Int. Cl.[2] ..... G03G 15/10; B05C 1/08

[58] Field of Search ..... 355/10; 118/262, DIG. 23; 427/17

[56] References Cited

UNITED STATES PATENTS

| | | | |
|---|---|---|---|
| 470,164 | 3/1892 | Newell | 118/262 X |
| 3,931,792 | 1/1976 | Sato | 118/DIG. 23 |

*Primary Examiner*—George H. Miller, Jr.
*Attorney, Agent, or Firm*—James J. Ralabate; Ernest F. Chapman

[57] ABSTRACT

An electrostatographic apparatus having a movable liquid development assembly to compensate for variance between the liquid developer applicator roll and the imaging surface in which the development assembly comprises a reservoir receptacle having a liquid developer applicator roll member movable into and out of contact with the surface of an imaging member, the receptacle having support means including a plurality of arms to suspend the development assembly from a fixed support.

11 Claims, 2 Drawing Figures

DEVELOPER ASSEMBLY SUPPORT

BACKGROUND OF THE INVENTION

The present invention relates to liquid development of electrostatic latent images, and more particularly relates to means for achieving a uniform development zone between a liquid developer applicator and an imaging member.

In electrostatographic copying machines, the development of the latent image on the photoreceptor advantageously is carried out by providing a developer fluid in operative engagement with an imaging member such as a photoreceptor whereby the liquid developer is attracted to the imaging member or photoreceptor in the charged areas. Subsequently, the photoreceptor is brought into contact with an interposing material, e.g., sheet material such as paper so that the developed images are transferred thereto to produce the desired copy. Further particulars of the general concept of liquid development in copying machines may be found in U.S. Pat. No. 3,084,043, for example.

In a preferred prior art electrostatic latent image development mode, liquid developer may be advantageously brought into operative contact with the imaging member by means of an applicator roll that rolls over the charged imaging member. A typical example of such an arrangement is shown in U.S. Pat. Nos. 3,084,043 and 3,806,354 which describes electrostatographic copying apparatuses and methods wherein the applicator is a rigid cylindrical member having on its surface a pattern of grooves and ridges which comprise lands and valleys, respectively. A liquid developer is maintained in the valleys below the surface of the lands. The applicator is positioned to come into contact with a photoreceptor bearing on its surface an electrostatic latent image. In a typical electrostatographic copying apparatus the imaging member or photoreceptor is also a cylindrical member comprising a conductive substrate and a photoconductive coating which supports the electrostatic latent image. The electrostatic latent image is produced by first charging the entire surface of the imaging member or photoreceptor in the dark and then by exposing the charged surface to imagewise radiation. The portions of the charged photoreceptor surface which are struck by the radiation are discharged, leaving an image pattern of charged on the photoreceptor surface in the non-radiation-struck areas.

The photoreceptor surface bearing the electrostatic latent image and the applicator are brought into moving contact during which the liquid developer is drawn to the photoreceptor from the valleys of the applicator roller by the charges which form the electrostatic latent image. Typically, the image is then transferred to an image receiving member such as an interposer web or paper by pressure contact between the photoreceptor and a roller.

Although both of the surfaces may be flat, it is more common for at least one of the surfaces to be arcuate to facilitate the moving of the applicator past sequential points on the photoreceptor while the two are in contact. In compact electrostatographic copying devices the surfaces are small diameter cylinders to facilitate the cooperative movement of the surfaces in a confined space. Such movement typically occurs at speeds of about 4 inches per second, although moving contact resulting in the transfer of liquid developer from the applicator to the photoreceptor occurs at speeds ranging generally from about 2 to about 70 inches per second.

To assure proper development of a uniform nip width or development zone must be provided across the area of contact between the developer applicator roll and the photoreceptor during their movement together to provide a substantially uniform length of time and space in the areas of contact during which the liquid developer is able to move from the applicator valleys to the photoreceptor surface. If this nip width or development zone is uniform, substantially uniform amounts of liquid developer will be transferred to the photoreceptor in response to substantially equally charged portions of the image. Most of the prior art development processes and devices do not provide means for maintaining this desirably uniform nip width or development zone.

Movement of a brush developing station toward and away from a photoreceptive drum assembly whereby the inspection, repairs and maintenance of the developing station are facilitated, has been proposed in British Pat. No. 1,317,289. In that disclosure however, the means for providing movement of the brush developing station are not adequate for maintaining a uniform nip or development zone between a liquid developer applicator roll and an imaging member.

OBJECTS OF THE INVENTION

Accordingly, it is the main object of this invention to provide an electrostatographic apparatus capable of supplying uniform quantities of liquid developer to an imaging member.

It is another object of this invention to provide means for compensating for variances between a liquid developer supply or applicator roll and an imaging member in the development of latent electrostatic images.

Still another object of this invention is to provide means for uniformly engaging the liquid developer supply or applicator roll along the length of contact of the roll with the imaging member.

Another object of this invention is to provide a device which achieves uniform nip width between the liquid developer applicator roll and the imaging member across the width of contact regardless of any expected variances in ovality, eccentricity or misalignment occurring between these elements.

SUMMARY OF THE INVENTION

These and other objects are accomplished by providing an electrostatographic apparatus including a liquid developer applicator assembly having support means therefor, said liquid developer applicator assembly having an applicator roll movable into and out of contact with the surface of an imaging member, said support means including a plurality of arms holding said liquid developer applicator assembly for movement in a plane generally perpendicular to said imaging member surface at the area of contact with said applicator roll when they are in contact, to compensate for variances therebetween and provide a uniform width of engagement along the length of contact.

Additional objects of this invention will become apparent to those versed in the art of electrostatic copying machines in view of the following detailed description of the apparatus taken in conjunction with the accompanying drawings in which preferred embodiments of the apparatus are shown.

DESCRIPTION OF THE PREFERRED EMBODIMENTS

Figure 1:
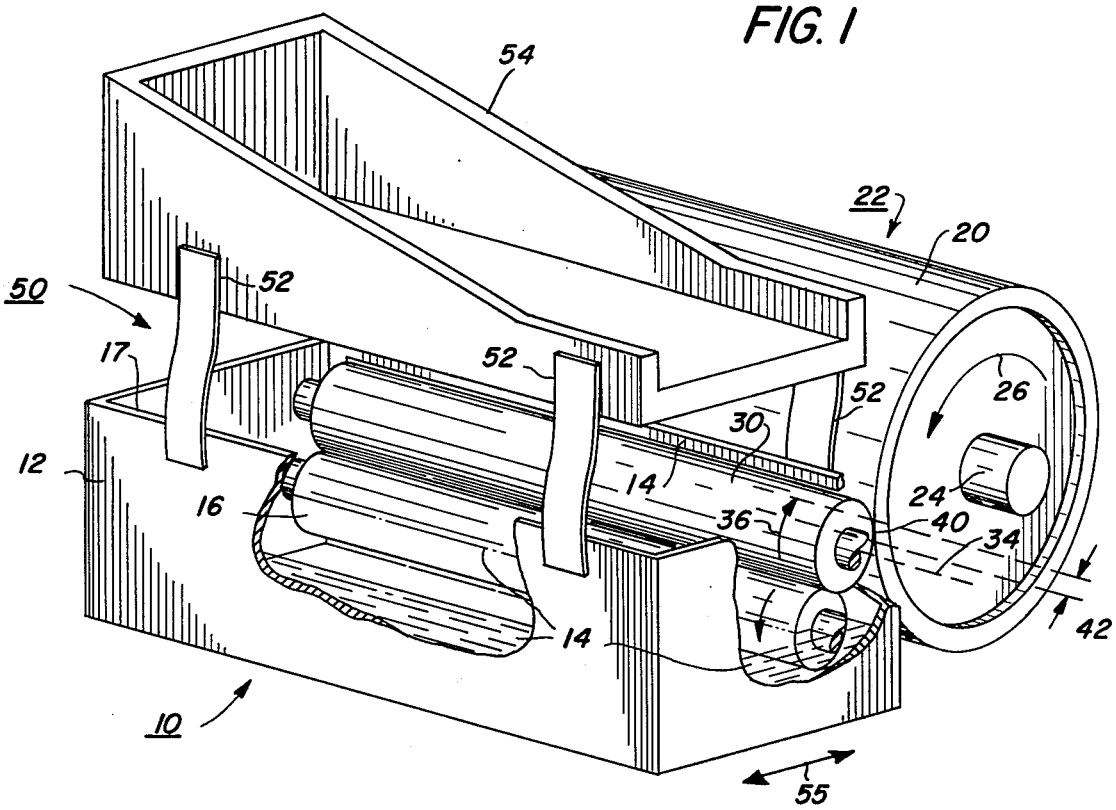
FIG. 1 is a schematic perspective view showing a liquid development assembly supported according to the invention with its applicator roll providing a uniform development zone across the width of a photoreceptor.

Referring to FIG. 1 there is illustrated a liquid development assembly generally indicated by numeral 10 including a receptacle or reservoir 12 which is adapted to hold fluid developer 14 which is to be transferred to an imaged photoconductive member such as photoreceptive charged/surface 20. The surface 20 may be of various configurations and may be any of the conventional imaging members and materials normally used in the art and as shown is the outer surface of a cylindrically shaped drum 22 that revolves around an axis 24 in a direction indicated by the arrow 26. As referred to above, it has been found that the liquid developer is advantageously applied to the photoconductive surface by means of a roller carrying developer fluid on or near its outer surface. Conventional developer fluids described in the art may be used, typical developer fluids and modes of application being described in U.S. Pat. Nos. 3,084,043 and 3,806,354.

In FIG. 1, a roll 30 is mounted on the receptacle 12 to rotate in a direction 36 about an axis 34. The roll 30 may be in communication with the supply of liquid developer in the receptacle 12 either directly (not shown) or by means of an intermediate feed roll 16. Whatever the specific means employed for purposes of this invention, the applicator roll 30 will have the proper amount and distribution of fluid 14 to allow even transfer of the fluid to the surface 20 under proper conditions.

One of the most important conditions is that the width of the area of contact between the roll 30 and surface 20 be uniform along the length of engagement. The nip width in this exemplary embodiment is the zone of substantial contact between the two surfaces. Substantially uniform nip width, which is provided in this embodiment by a deformable photoreceptor surface, is achieved whenever the zone of substantial contact between the surfaces varies less than an amount which would produce a noticeable variation in copy quality across the imaged sheet material. The establishing of a substantially uniform nip width and of substantial contact as the surfaces move in operative contact provides substantially uniform periods of time during which the liquid developer is able to move from the applicator valleys to the photoreceptor surface across substantially uniform gap which is never in excess of 0.0005 inch (0.00127 cm). Thus, substantially uniform amounts of liquid developer are transferred to the photoreceptor in response to substantially equally charged portions of the image.

The uniform nip is provided according to the present invention in FIG. 1 where an area of contact 40 has a uniform width 42 across the length of engagement between the roll 30 and surface 20. The uniform width assures a development zone in the area 40 that provides equal time and space across the surface 20 for the development ink to adhere to the charged surface 20. The periphery of roll 30 and surface 20 move at the same speed in response to suitable drive arrangements not shown.

While every attempt is made during manufacture and assembly of the various components of the above-described system to achieve accuracy, it will be understood that perfection is difficult and that variations of size and placement within tolerances, must be accepted. Further variances may occur during usage and maintenance. Thus, variances may occur in the roundness of the drum 22 and applicator roll 30; misalignment of the axes 24 and 34; and eccentricity of the components about their axes. Each of these variances may effect the relationship between the development assembly 12 with its applicator roll 30 and the surface 20 such that the development zone 40 will not be uniform as desired.

To compensate for these variations there is provided a support means for the development assembly 12 which provides a latitude of movement thereto. In the illustrated embodiment of FIG. 1, a support means generally indicated at 50 includes a plurality of arms 52 which are attached to and extend from the development assembly 12 to an upper support member 54 to which they are attached, upper support member 54 preferably being stationary. In practice, it has been found that the arm members 52 may be of a flexible material such as spring steel. Phosphor bronze and stiff synthetic plastic materials also have been found to be acceptable. While it is to be expected that the dimensions and characteristics of the arms 52 will differ with the load they carry, their movement and the variances encountered, it will be understood that the over-riding criteria is that the arms be flexible enough over their length to move and twist generally in a plane substantially perpendicular to the photoreceptor at the area of contact to allow the development assembly to accommodate these variances. With the arrangement in FIG. 1, the arms 52 would twist if only one end of roll 30 had to move in to keep the uniform nip area 40 and would flex to accommodate a uniform eccentricity.

The square or rectangular configuration for the developer receptacle 12 is typical with the applicator roll being positioned adjacent a forward wall portion 14 and a rear-ward portion 17 generally parallel thereto and spaced therefrom. In a case such as this at least one support arm 52 will be rigidly fixed at one end to portion 14 and at the other end to the support 54. Similarly, side 17 will have at least one member 52 fixed between it and support 54. One skilled in the art, however, can provide other receptacle configurations and designs which would bias the applicator roll against the imaging surface when used in conjunction with the support means of the present apparatus.

While the placement of the arms 52 at the front and back and in a parallel relationship is preferred in this environment because the majority of movement may be expected to occur in the directions illustrated by an arrow 55 and because the flat strap-like arms 52 are most flexible in that direction, it is contemplated that the principles of the invention may be applied to other situations with different constructions. For example, in the embodiment shown in FIG. 2 a development assembly receptacle 112 similar to receptacle 12 is suspended from a support 154 by two pairs of arms 152, on each opposite side thereof. Only one pair of arms 152 may be seen as the other pair is hidden. in this view. In this case, the top and bottom ends of the arms 152 are loosely attached to the support 154 and receptacle 112 at pivot points 156 and 157 respectively. A degree of play is left in the pivot connections. Thus, in this instance, compensation of variances between the two rolls, which cannot be great, is accomplished by movement of the container in a substantial parallelogram motion. If only one end of one roll has to conform, such as would be the case with misalignment, the clearance at the pivot points 156 and 157 would be sufficient to allow the receptacle 112 to skew such that the variance will be accomodated.

Figure 2:
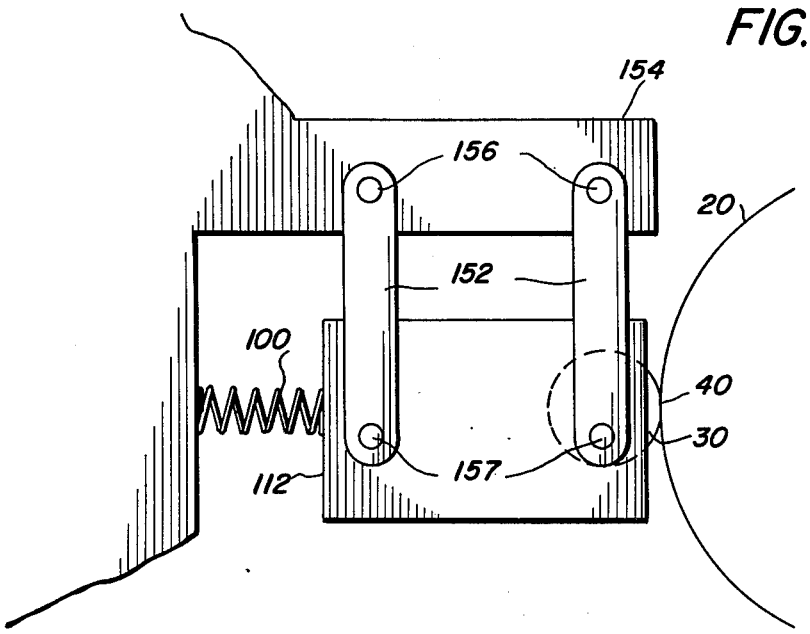
FIG. 2 is a schematic elevational view of another apparatus of the invention.

In the most preferred embodiments shown in FIGS. 1 and 2, the stationary or fixed support is located in a position above the receptacle or reservoir and in these cases the force of gravity may be sufficient to bias the applicator roll against the imaging member or against an interposition web or material intermediate the applicator roll and the imaging member.

Pressure may be applied to the applicator roll 30 to hold it in uniform contact with the surface 20 by a number of different means. For example, where exactly even pressure must be applied at one or a number of different points on the receptacle 12 a suitable hydraulic means (not shown) may be provided. In many cases a single centrally located biasing member, for example, spring 100 as shown schematically in FIG. 2 or several identical springs in a balanced arrangement (not shown) may be used to provide even pressure to the receptacle and applicator roll 30 over any range of expected movement.

In FIG. 1, the flexure strips 52 may be made of a suitable spring material and react against the stationary support 54 to urge the receptacle 12 and the roll 30 against the surface 20. This inherent spring force may supplement or be in place of an external spring force such as shown at 100. In FIG. 2, the biasing members or springs may be positioned at the pivot points 156 and/or 157 to provide the force for biasing the applicator roll into engagement with the photoreceptor. It will be noted that the embodiment of FIG. 1 is frictionless in the fact that two surfaces do not move against one another.

While it is not required in the present invention, the applicator roll may be moved out of contact with the photoreceptor 20 by a suitable cam arrangement after each machine cycle. In such case, the ability of the assembly to return to a uniform nip or development zone 40 after each cycle is very important and is accommodated by the structure set out herein.

From the foregoing it will be appreciated that the invention provides a means for achieving a substantially uniform development zone between a liquid development applicator and a charged photoreceptor that overcomes the limitations of prior art.

Liquid development modes have been discussed supra in the background of the invention, and it is deemed within the purview of one skilled in the art to provide suitable imaging members, cleaning systems, charging systems, imaging means, developing systems, transfer systems, liquid developers and the like, especially in view of the disclosure in U.S. Pat. Nos. 3,084,043 and 3,805,354 incorporated herein by reference. In U.S. Pat. No. 3,084,043 there is disclosed and claimed a method of developing a xerograhic latent image with a liquid developer on an image bearing surface by providing flow aiding elements in physical contact between said developer and said image bearing surface whereby developer moves along said flow aiding elements and develops the image. In U.S. Pat. No. 3,806,354 there is disclosed an electrostatographic imaging system wherein an electrostatic latent image is developed by placing the imaging surface in developing configuration with a patterned applicator surface having a substantially uniform distribution of raised portions or "lands" and depressed portions or "valleys" and containing a relatively non-conductive liquid developer in the depressed portions thereof while the raised portions are substantially free of developer. In brief, there is claimed therein a method of cyclically developing electrostatic latent images present on a reusable imaging surface comprising forming the image; providing an applicator having raised and depressed portions, the depressed portions having liquid developer of a bulk resistivity of from about $10^{10}$ ohm cm to about $10^{14}$ ohm cm therein; positioning the applicator adjacent the imaging surface such that the liquid developer develops the electrostatic image in image configuration; transferring the liquid developer to a receiving surface; and preparing the reusable imaging surface for the next imaging and development sequence.

For ease of illustration and description, there are no doctor blades, cleaning blades and other devices conventionally used in transferring liquid developer from a liquid developer supply to the ink applicator roll and the surface of the imaging member. It is deemed to be within the purview of one skilled in the art to provide these systems in a liquid development apparatus. Other conventional liquid development modes and embodiments using interposition webs for development and transfer may also be utilized with the present invention and in certain cases the applicator roll may contact an interposition surface rather than the imaging member itself. However, in such cases, it is deemed that the phrase "biasing of the applicator roll against the imaging member" may be used interchangeably with the phrase "biasing the applicator roll against the interposition surface."

It will also be understood that various modifications may be made to the embodiments in the drawings and specific examples referred to herein without departing from the scope of the invention as defined in the appended claims.

What is claimed is:

1. An electrostatographic apparatus comprising a liquid development assembly having support means therefor, said liquid development assembly having an applicator roll movable into and out of contact with the surface of an imaging member, said support means including a plurality of arms holding said liquid development assembly for movement in a plane substantially perpendicular to said imaging member surface at the area of contact with said applicator roll when they are in contact to compensate for variances therebetween and provide a uniform width of engagement along the length of contact.

2. A device according to claim 1 wherein said development assembly has a forward portion adjacent to and generally parallel with said applicator roll and a rearward portion generally parallel to said applicator roll and spaced therefrom, at least one of said support means cooperating with each of said forward and rearward portions.

3. A device according to claim 1 wherein each of said support means are generally parallel to one another.

4. A device according to claim 1 wherein said imaging member is of a cylindrical shape, said applicator roll forming a uniform nip with the surface of said imaging member across the area of engagement.

5. A device according to claim 1 wherein said liquid development assembly is biased by an external spring force to urge said applicator roll against said imaging member.

6. A device according to claim 1 wherein said support means comprise flexible strap-like arms suspending said development assembly from a fixed support.

7. A device according to claim 6 wherein each of said arms is fixed at first end to said development assembly and at a second end to said fixed support.

8. A device according to claim 1 wherein said support means transmit a spring force to bias said applicator roll against said imaging member.

9. A device according to claim 8 wherein said support arms are each inherently a spring and provide said spring force.

10. A device according to claim 1 wherein said support means comprise pivotally mounted, structurally rigid arms suspending the development assembly from a fixed support.

11. A device according to claim 10 wherein each of said arms is pivotally mounted at a first end to the development assembly an at a second end to the fixed support.

* * * * *